US007950653B2

(12) United States Patent
Berendes

(10) Patent No.: US 7,950,653 B2
(45) Date of Patent: May 31, 2011

(54) THREE-WAY GUIDE FOR REDIRECTING SHEET-SHAPED MEDIA

(75) Inventor: Elmar Berendes, Warburg (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 12/665,196

(22) PCT Filed: Jun. 27, 2008

(86) PCT No.: PCT/EP2008/005263

§ 371 (c)(1),
(2), (4) Date: Dec. 17, 2009

(87) PCT Pub. No.: WO2009/018879

PCT Pub. Date: Feb. 12, 2009

(65) Prior Publication Data

US 2010/0194033 A1 Aug. 5, 2010

(30) Foreign Application Priority Data

Aug. 3, 2007 (DE) ..... 10 2007 036 663
May 16, 2008 (DE) ..... 20 2008 006 688 U

(51) Int. Cl.
*B65H 5/00* (2006.01)

(52) U.S. Cl. ..... 271/225; 271/264; 271/303

(58) Field of Classification Search ..... 271/225, 271/264, 267, 303
See application file for complete search history.

(56) References Cited

U.S. PATENT DOCUMENTS

| | | | | |
|---|---|---|---|---|
| 3,815,898 | A | 6/1974 | Haifley et al. | |
| 5,536,002 | A | 7/1996 | Yoshida et al. | |
| 6,394,446 | B1 | 5/2002 | Okamoto | |
| 7,093,831 | B2 * | 8/2006 | Biegelsen et al. | 271/184 |

FOREIGN PATENT DOCUMENTS

| | | | |
|---|---|---|---|
| DE | 3931571 | A1 | 3/1991 |
| DE | 19538066 | A1 | 4/1997 |
| DE | 19538066 | A1 * | 4/1997 |
| DE | 19648181 | A1 | 5/1998 |
| EP | 0313124 | A1 | 4/1989 |
| JP | 02013565 | A * | 1/1990 |

* cited by examiner

*Primary Examiner* — Stefanos Karmis
*Assistant Examiner* — Gerald W McClain
(74) *Attorney, Agent, or Firm* — Harness, Dickey & Pierce, P.L.C.

(57) ABSTRACT

A guide is proposed for devices for processing sheet material, particularly bank notes and checks, that is equipped with a guide body (1), with several guide wings (2) on the guide body (1), with at least three edges (15, 16, 17) on the guide wings (2) running parallel to each another and tapering to a point and with a guide drive (3, 4, 5) connected to the guide body (1) that sets the guide body (1) in motion in at least two different directions, wherein at least one of the two motions is a translational motion.

21 Claims, 4 Drawing Sheets

THREE-WAY GUIDE FOR REDIRECTING SHEET-SHAPED MEDIA

Figure 1:
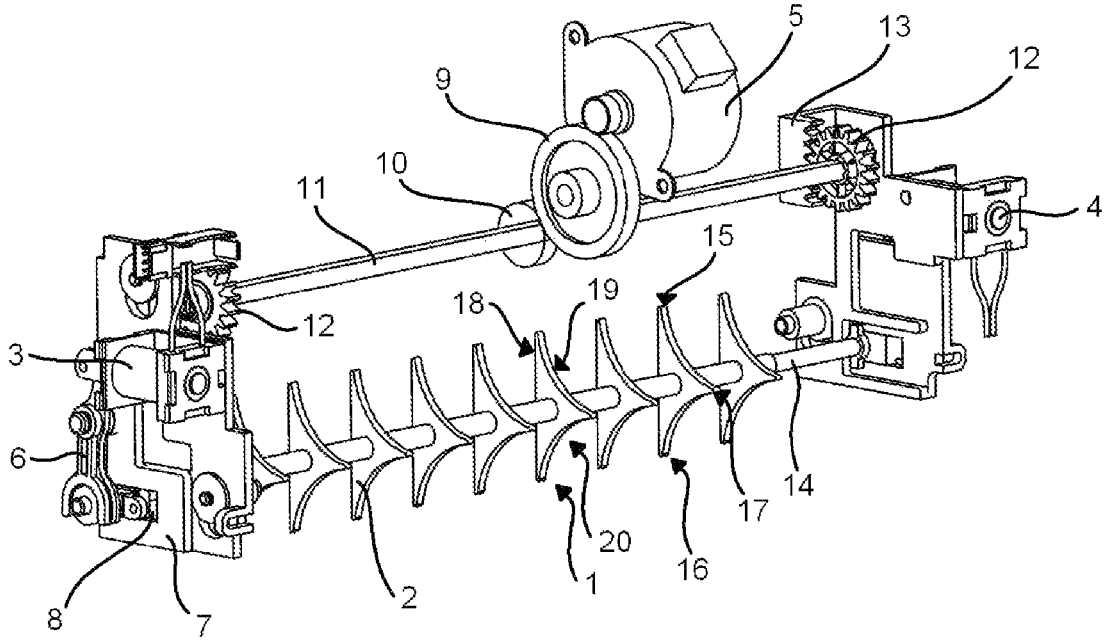

The invention relates to a guide for devices for processing sheet material, particularly bank notes and checks.

Guides of this nature serve to direct the sheet material in a device for processing sheet material in different directions while said material is being transported. Among the devices for processing sheet material may be included, for example, automated banking machines, sorting and counting devices, change machines, rail or bus ticket machines, admission ticket machines or pay and display parking ticket machines. Such devices and machines are able to guide the sheet material in different transport directions in order to convey it to temporary storage, for example, and return it to a customer as the need arises.

A two-way guide is known from the prior art in DE 39 31 571 A1 that is equipped with a guide body carried pivotably about an axis of rotation. The guide body can assume two positions. What the two positions accomplish is that bank notes take a different path when being transported to a storage roller and being wound onto the storage roller than when being unwound from the storage roller. The outward and return paths are thus different.

It proves disadvantageous that guides of this type allow only two different paths for the sheet material. The detachment of individual sheet-shaped objects from a plurality of sheet-shaped objects conveyed as well as the division of the sheet material conveyed into two different transport directions cannot be achieved with the known guides.

The object of the present invention is to provide a guide for processing sheet material that makes it possible to transport sheet material along more than two different paths.

The guide in accordance with the invention having the features of claim 1 is differentiated with respect to known guides in that the guide wings of the guide body are equipped with at least three edges running parallel to each other and tapering to a point, and that a guide drive is provided that sets the guide body in motion in at least two different directions, where at least one of the two motions is a linear, translational motion. Concerning the second motion, this can similarly be a translational motion or a rotational motion. The motion of the guide body during a change of position is thus made up of two translational motions in different directions, or a translational motion and a rotational motion. The motion composed of two translational motions is, however, particularly preferred.

The three edges running parallel to each other and tapering to a point define at least three sides of the guide wings that face the sheet material as it is being transported, depending on the guide position. Each of these sides serves to direct and guide the sheet material. The guide drive makes it possible for the guide body to be able to assume three different positions relative to its surroundings in order to take the sheet material along at least three different paths.

In accordance with an advantageous embodiment of the invention, the guide drive sets the guide body into a respective translational motion in two different directions. This makes any setting of the guide body possible relative to its surroundings.

In accordance with a further advantageous embodiment of the invention, the guide drive is configured as a magnetic drive. For example, such a drive may be one or more lift solenoids or rotary solenoids. They are preferably connected to one or both ends of the guide drive and ensure that the guide body changes position quickly. Additional guideways are advantageously provided to locate the guide body as precisely as possible.

In accordance with a further advantageous embodiment of the invention, the magnetic drive is equipped with a rocker arm to transmit the motion of the magnetic drive to the guide body. A linear guideway ensures that the translational motion of the guide body is effected as precisely as possible.

In accordance with a further advantageous embodiment of the invention, an electric motor is provided as the guide drive. Examples of electric motors are a stepper motor, a synchronous motor or a servo motor. Such motors have the advantage that they make it possible to position the guide body precisely.

In accordance with a further advantageous embodiment of the invention, a pinion gear with rack and pinion is provided to transmit the motion of the electric motor to the guide body. The pinion gear makes it possible to convert a rotational motion of the electric motor into a linear motion of the guide body.

In accordance with a further advantageous embodiment of the invention, the guide is equipped with a magnetic drive for translational motion in a first direction and an electric motor for translational motion in a second direction. To achieve translational motion in a first direction, the guide body is actuated by one or two solenoids, for example lift solenoids or rotational solenoids. An electric motor is provided to enable translational motion in a second direction. To achieve this, the entire unit consisting of guide body and magnetic drive is moved by the electric motor. Care must be exercised in so doing that the guide body precisely maintains the position established by the magnetic drive and the electric motor and does not wobble. Precise positioning of the guide body is necessary so that dependable routing of the sheet material can be guaranteed and any damage to the sheet material, as well as a sheet material jam, can be avoided. The motions must, therefore, take place without any lash. A locator plate is advantageously provided to locate the guide body and to prevent the guide body from detaching itself from its prescribed position. Both the guide body and the magnetic drive are disposed on this locator plate. The motion of the electric motor is transmitted to the locator plate by a gear.

In accordance with a further advantageous embodiment of the invention, the guide wings have a long side parallel to the three edges running parallel to each other and tapering to a point, which is defined by two of the three edges. The long side is configured as a planar surface. Said long side serves to transport the sheet material in a straight line. In this case, there is no change in the direction of the sheet material as it is transported through the guide.

In accordance with a further advantageous embodiment of the invention, the guide wings have at least one deflector side that is defined by two of the three edges running parallel to each other and tapering to a point. The deflector side is curved inward. The sheet material undergoes a change of direction as it transported along the deflector sides. The angle by which the direction changes depends on the curvature of the deflector side. Said angle is determined by the two tangents on the deflector side in the area of the two edges defining the deflector side. The angle is included by these two tangents. The guide wings can have several deflector sides.

In accordance with a further advantageous embodiment of the invention, the guide is equipped with at least one transport plate that lies opposite the long sides of the guide wings. The transport plate has recesses and/or depressions for the long sides of the guide wings. While the guide body can change its position due to the guide drive, the transport plate is disposed stationary on the guide. If the transport path along the long side is to be opened up, the guide body is positioned at a distance from the transport plate in such a way that guide body and transport plate define a gap through which the sheet material can be taken. However, if the transport path is to be blocked in the lengthwise direction, the guide body is brought up to the transport plate in such a way that the long sides of the guide wings are submerged into the recesses and/or depressions of the transport plate. A different transport path is opened up in this way. The partial submersion or penetration of the guide wings into the recesses or depressions of the transport plate prevents the sheet material from colliding with the edges of the guide wing tapering to a point. Collisions of this nature could trigger a sheet material jam, or the sheet material could be damaged.

In accordance with a further advantageous embodiment of the invention, the transport plate is equipped with several parallel transport ribs. The interspace between the transport ribs forms the depressions for the guide wings. The transport ribs may either be configured in one piece with the transport plate or attached as strips to the transport plate.

In accordance with a further advantageous embodiment of the invention, the guide is equipped with at least one deflector plate that lies opposite the deflector sides of the guide wings. The deflector plate is equipped with recesses and/or depressions for the deflector sides of the guide wings. In contrast to the guide body, the deflector plate is disposed stationary on the guide. If the guide body is positioned relative to the deflector plate in such a way that a clearance exists between the deflector sides of the guide wings and the deflector plate, the sheet material can be transported through the gap between the deflector sides of the guide wings and the deflector plate. If, on the other hand, the guide body is brought so close to the deflector plate that the deflector sides of the guide wings penetrate into the recesses of the deflector plate, the transport path along the deflector sides of the guide wings is blocked.

In accordance with a further advantageous embodiment of the invention, the deflector plate is equipped with several parallel deflector ribs. The depressions for the deflector sides of the guide wings are formed by the interspace between the deflector ribs. The deflector ribs can either be formed in one piece with the deflector plate or attached to the deflector plate as supplementary strips. The partial submersion of the guide wings into the recesses, or interspaces, of the deflector plate, prevents the sheet material from colliding with the edges of the guide wing running parallel and tapering to a point. In this way, damage to the sheet material and a sheet material jam during transportation through the guide are prevented.

Further advantages and advantageous embodiments of the invention will become apparent from the drawing, the following description and the claims.

An embodiment of the subject of the invention is shown in the drawing.

Figure 2:
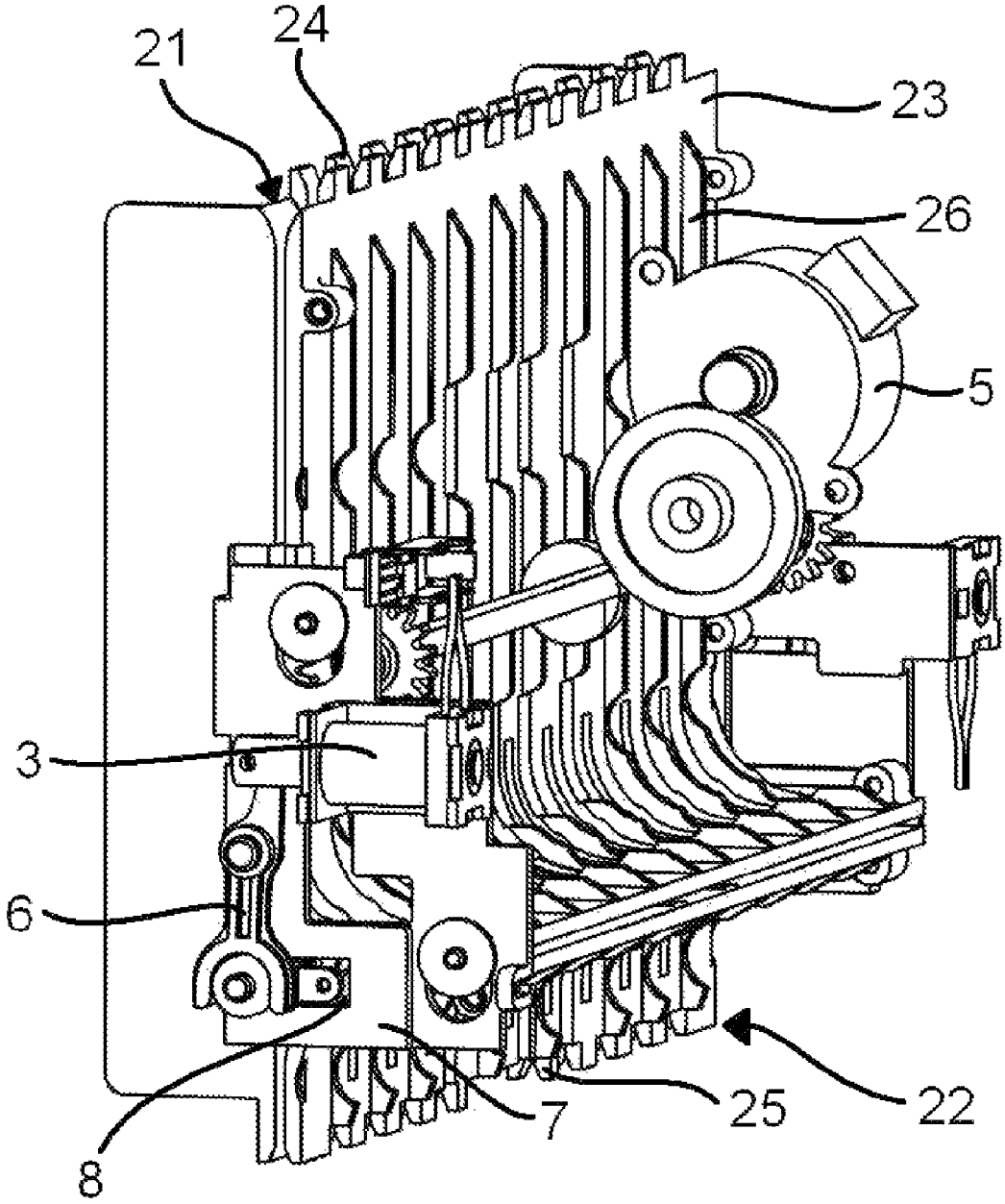
Figure 3:
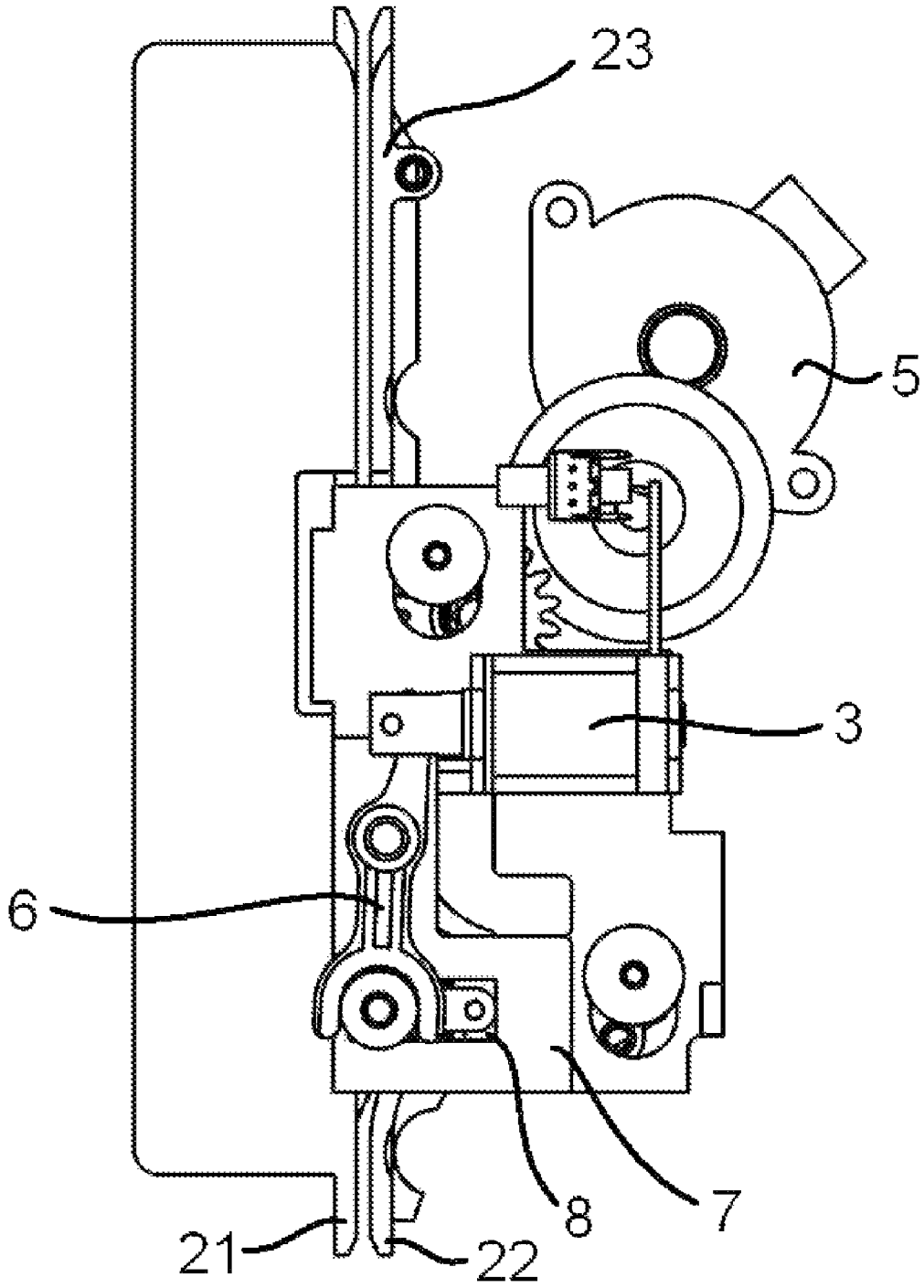
Figure 4:
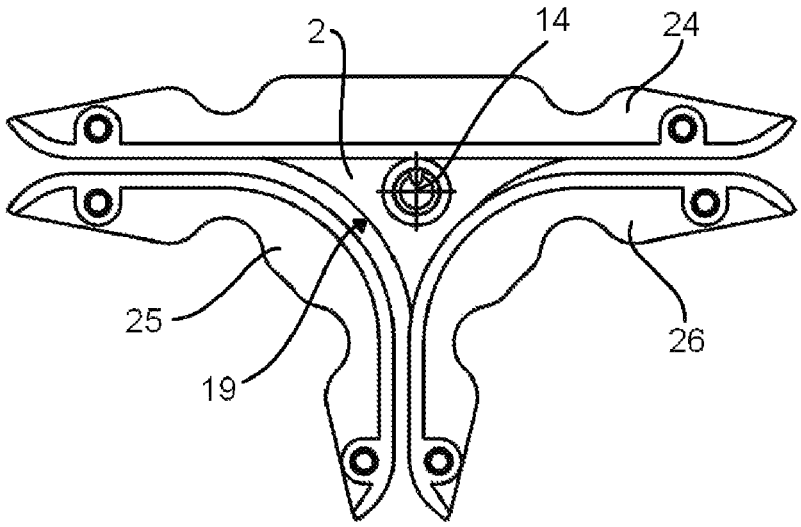
Figure 5:
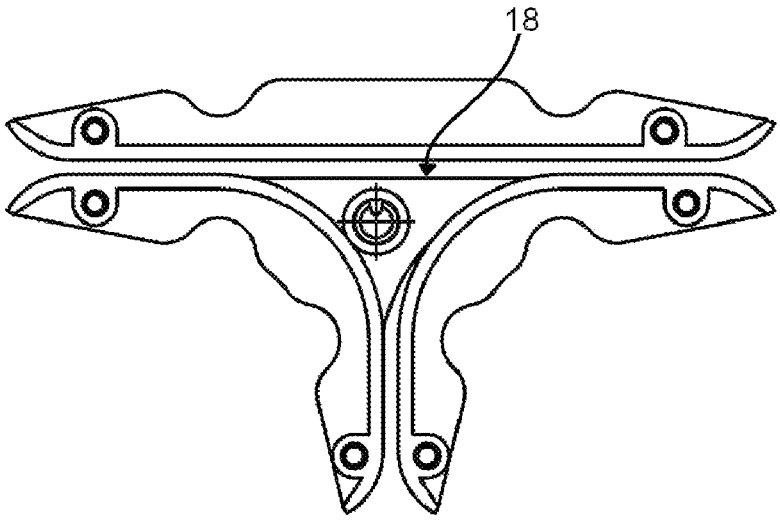
Figure 6:
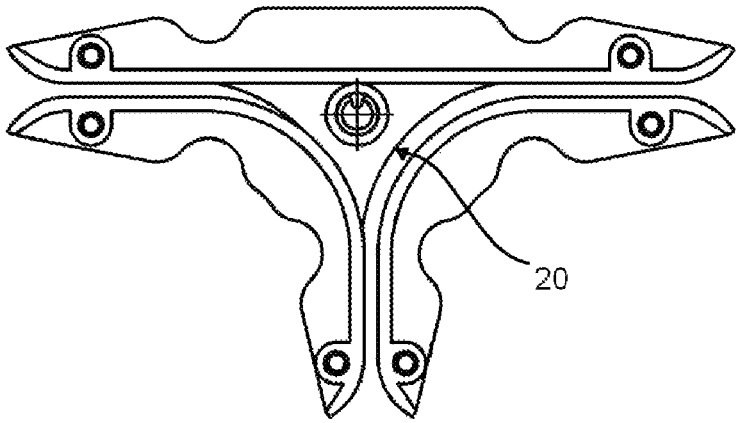

FIG. 1 shows guide body and guide drives in a perspective representation,

FIG. 2 shows guide with guide body and guide drives from FIG. 1 in a perspective view, FIG. 3 shows guide from FIG. 2 in a side elevation, FIG. 4 shows a first possible setting of the guide wings relative to the transport plate and the two deflector plates, FIG. 5 shows a second possible setting of the guide wings relative to the transport plate and the two deflector plates, FIG. 6 shows a third possible setting of the guide wings relative to the transport plate and the two deflector plates.

FIG. 1 shows a guide with a guide body 1, with several guide wings 2 and a total of three guide drives 3, 4 and 5 in a perspective view. In the case of the two guide drives 3 and 4, lift solenoids are involved. The motion of the two lift solenoids 3 and 4 is transmitted via two rocker arms 6 to the ends of guide body 1. Only one of two rockers arms 6 is visible in the drawing. In order to ensure that guide body 1 executes a straight-line motion, the two ends of guide body 1 are located respectively in a locator plate 7 that is equipped with two locator slots 8 for the ends of guide body 1.

In the case of guide drive 5, it concerns a stepper motor. The motion of the stepper motor is transmitted via two drive wheels 9 and 10 and a drive shaft 11 to two pinion gears 12. Pinion gears 12 in turn roll against two racks 13, of which only one can be seen in the drawing. The racks 13 are part of the two locator plates 7. The drive via stepper motor 5 results in the entire unit of guide body 1, locator plates 7, and lift solenoids 3 and 4 with rocker arms 6 moving up or down.

Guide body 1 consists of a guide spindle 14 and a total of eight guide wings 2. The guide wings are rigid and disposed stationary on the guide spindle. Each of the guide wings 2 is configured as a plate and has three edges 15, 16 and 17 running parallel to each other and tapering to points. The three edges of each guide wing 2 are parallel to each other. They define a planar long side 18 and two inwardly curved deflector sides 19 and 20. The sheet material, which is not shown on the drawing, slides along the long side 18 and the two deflector sides 19 and 20 while it is passing the guide. Along which of the three sides 18, 19 and 20 the sheet material is conveyed depends on the position assumed in FIGS. 4, 5 and 6 by guide body 1.

FIG. 2 shows the entire guide in a perspective representation. Guide body 1 cannot be seen in FIG. 2 because it is concealed by transport plate 21 and the two deflector plates 22 and 23. Lift solenoid 3, stepper motor 5, rocker arm 6, locator plate 7 with locator slot 8 and the gear of stepper motor 5 are identifiable in FIG. 2. Transport plate 21 and the two deflector plates 22 and 23 are equipped with transport ribs 24 and deflector ribs 25 and 26. Every two of these ribs define an interspace that, together with a recess in transport plate 21 and deflector plates 22 and 23, forms a depression into which guide wings 2 can at least partially penetrate. This can be seen in FIGS. 4 to 5.

FIG. 3 shows the guide from FIG. 2 in a side elevation.

FIGS. 4, 5 and 6 show possible positions for the guide body relative to the transport plate and the two deflector plates. For the sake of simplicity, the three drawings contain only one guide wing 2, guide spindle 14 and one transport rib 24 of the transport plate 21, one deflector rib 25 of deflector plate 22 and one deflector rib 26 of deflector plate 23 respectively. Since this is a side elevation, a view into the recesses formed by the ribs is not possible. The Figures reveal only that guide wings 2 can penetrate into the recesses as far as guide spindle 14.

In the position of guide body 4 shown in FIG. 4, guide wing 2 is submerged along its long side 18 into the depression formed by transport rib 25 of transport plate 21 as far as guide spindle 14. The guide wing closes off the gap between transport plate 21 and deflector plate 23 and opens the path between transport plate 21 and deflector plate 22, and also between the two deflector plates 22 and 23. In this position, the sheet material coming from the left is guided downward. Thanks to the long side of guide wing 2 being submerged into the recess, the sheet material is prevented from colliding with the edge 15 of guide wing 2 tapering to a point shown in FIG. 1. In the position from FIG. 4, edge 15 is accommodated completely by the depression formed by two transport ribs 24.

In the position of the guide body from FIG. 5, the sheet material is transported from left to right in a straight line. In this position, guide wings 2 with their deflector side 19 submerge completely into the depression formed by deflector ribs 24 of deflector plate 22. In this position, edge 15 of guide wings 2 tapering to a point is completely accommodated in the depression. Said edge is therefore not identifiable in FIG. 5. A collision between the sheet material and edge 15 of guide wings 2 tapering to a point can thereby be avoided. If the sheet material is to be transported from right to left, the guide body is shifted to the right so that edge 16 tapering to a point is completely accommodated in the depression formed by deflector ribs 26 of deflector plate 23. This position is not shown in FIGS. 4 to 6. When transported from right to left, the sheet material slides along long side 18 of deflector wings 2.

In the position of the guide body from FIG. 6, guide wings 2 are similarly submerged with their long side in the depressions formed by transport ribs 24 of transport plate 21. In this case, however, guide wings 2 are shifted to the left so that the sheet material is transported along deflector side 20. Transportation takes place from the right downward. The edge 16 of guide wings 2 tapering to a point is in this case completely submerged into the depressions formed by transport ribs 24 of transport plate 21 so that the sheet material cannot collide with said edge. In this position, the gap between transport plate 21 and guide wings 2 and between deflector plate 22 and guide wings 2 is covered. Only the gap between deflector plate 23 and guide wings 2 is open for transportation.

FIGS. 4, 5 and 6 show only three possible settings for guide body 1. Three additional settings for the guide body are possible for transport in opposite directions that are not shown in the drawing. In this case, care is exercised to ensure that the respective edge 15, 16 or 17 of guide wings 2 tapering to a point, which the sheet material approaches first as it is being transported, is accommodated in the respective depression of deflector plates 22 and 23, or of transport plate 21, to prevent the sheet material from striking said edge.

All the features of the invention can be essential to the invention, both individually as well as in any combination with each other.

REFERENCE NUMERAL LIST

1 Guide body
2 Guide wing
3 Lift solenoid
4 Lift solenoid
5 Stepper motor
6 Rocker arm
7 Locator plate
8 Locator slot
9 Drive wheel
10 Drive wheel
11 Drive shaft
12 Pinion gear
13 Rack
14 Guide spindle
15 Edge tapering to a point
16 Edge tapering to a point
17 Edge tapering to a point
18 Long side
19 Deflector side
20 Deflector side
21 Transport plate
22 Deflector plate
23 Deflector plate
24 Transport rib
25 Deflector rib
26 Deflector rib

What is claimed is:

1. Guide for devices for processing sheet material with a guide body, with several guide wings on the guide body, with at least three edges running parallel to each other and tapering to a point on the guide wings, with a guide drive connected to the guide body that sets the guide body in motion in at least two different directions, where at least one of the two motions is a linear translational motion; wherein the guide wings include one straight guide and two curved guides.

2. Guide from claim 1, wherein the guide wings have a long side parallel to the three edges running parallel to each another and tapering to a point, wherein the long side is defined by two of the three edges, and wherein the long side is configured as a planar surface.

3. Guide from claim 1, wherein the guide drive is configured as a magnetic drive.

4. Guide from claim 3, wherein the guide drive is equipped with a rocker arm and a linear guide to transmit the motion of the magnetic drive to the guide body.

5. Guide from claim 1, wherein the guide drive is configured as an electric motor.

6. Guide from claim 5, wherein the electric motor is a stepper motor, a synchronous motor or a servo motor.

7. Guide from claim 6, wherein the guide is equipped with a gear drive with a pinion and rack to transmit the motion of the electric motor to the guide body.

8. Guide from claim 5, wherein the guide drive is equipped with a gear drive with a pinion and rack to transmit the motion of the electric motor to the guide body.

9. Device for processing sheet material, wherein the device is equipped with a guide from claim 1.

10. Device from claim 9, wherein the sheet material consists of bank notes or checks.

11. Guide from claim 1, wherein the guide wings have at least one deflector side, wherein the deflector side is defined by the three edges running parallel to each other and tapering to a point, and wherein the deflector side is curved inward.

12. Guide from claim 11, wherein the guide is equipped with at least one deflector plate that lies opposite the deflector sides of the guide wings, wherein the deflector plate is equipped with recesses or depressions for the deflector sides of the guide wings.

13. Guide from claim 12, wherein the deflector plate is equipped with several parallel deflector ribs, and wherein the depressions are formed by the interspaces between the deflector ribs.

14. Guide from claim 1, wherein the guide drive sets the drive body in a linear translational motion in two different directions respectively.

15. Guide from claim 14, wherein the guide drive is equipped with a magnetic drive for translational motion in a first direction and with an electric motor for translational motion in a second direction.

16. Guide from claim 15, wherein the guide is equipped with a locator plate to locate the guide body.

17. Guide from claim 16, wherein the guide is equipped with at least one transport plate that lies opposite long sides of the guide wings, and wherein the transport plate is equipped with recesses or depressions for the long sides of the guide wings.

18. Guide from claim 17, wherein the transport plate is equipped with several parallel transport ribs, and wherein the depressions are formed by interspaces between the transport ribs.

19. Guide from claim 14, wherein the guide drive is configured as a magnetic drive.

20. Guide from claim 14, wherein the guide drive is configured as an electric motor.

21. Guide from claim 1, wherein the sheet material consists of bank notes or checks.

* * * * *